US011319041B2

(12) United States Patent
Wang et al.

(10) Patent No.: US 11,319,041 B2
(45) Date of Patent: May 3, 2022

(54) RECOVERY DEVICE AND RECOVERY METHOD OF UNMANNED UNDERWATER VEHICLES

(71) Applicants: ZHEJIANG OCEAN UNIVERSITY, Zhejiang (CN); SHANGHAI ZHENHUA HEAVY INDUSTRIES COMPANY LIMITED, Shanghai (CN)

(72) Inventors: Huaming Wang, Zhejiang (CN); Liangzhou Mao, Zhejiang (CN); Xiaofei Wang, Shanghai (CN); Lin Chen, Zhejiang (CN); Yongsheng Huang, Zhejiang (CN); Qiaorui Wu, Zhejiang (CN); Xiaojun Zhang, Zhejiang (CN); Zhenhuang Du, Zhejiang (CN); Guorong Wu, Zhejiang (CN); Junmei Liu, Zhejiang (CN); Xiaoyi Fang, Zhejiang (CN); Jiang Ying, Zhejiang (CN)

(73) Assignees: ZHEJIANG OCEAN UNIVERSITY, Zhoushan (CN); SHANGHAI ZHENHUA HEAVY INDUSTRIES COMPANY LIMITED, Shanghai (CN)

( * ) Notice: Subject to any disclaimer, the term of this patent is extended or adjusted under 35 U.S.C. 154(b) by 0 days.

(21) Appl. No.: 17/120,161

(22) Filed: Dec. 12, 2020

(65) Prior Publication Data

US 2021/0284298 A1 Sep. 16, 2021

(30) Foreign Application Priority Data

Mar. 16, 2020 (CN) ..... 202010183606.9

(51) Int. Cl.
*B63G 8/00* (2006.01)
*B63C 7/22* (2006.01)
(Continued)

(52) U.S. Cl.
CPC ..... *B63C 7/22* (2013.01); *B63C 7/02* (2013.01); *B63H 11/00* (2013.01); *B63B 2027/165* (2013.01); *B63G 2008/008* (2013.01)

(58) Field of Classification Search
CPC ..... B63B 2027/165; B63C 7/22; B63G 2008/008; B63G 8/42; B63G 2008/425
See application file for complete search history.

(56) References Cited

U.S. PATENT DOCUMENTS 2,347,491 A * 4/1944 Lente ..... B63C 7/22 114/51
6,390,012 B1 * 5/2002 Watt ..... B63B 27/36 114/322

(Continued)

FOREIGN PATENT DOCUMENTS

AU 2013248499 B2 4/2016
CN 106043632 B 7/2018

(Continued)

*Primary Examiner* — Andrew Polay

(57) ABSTRACT

A recovery device for an unmanned underwater vehicle (UUV) includes a first recovery component arranged on an unmanned ship and a second recovery component arranged on the UUV. Two magnets are provided on an end of the first recovery component and an end of the second recovery component which are opposite to each other, respectively. A first cable of the unmanned ship is provided on an end of the first recovery component away from the magnet, and a second cable is provided on an end of the second recovery component away from the magnet. A thruster is provided on a side of the first recovery component. The UUV is recovered using the unmanned ship through the recovery components connected to the cables, which allows the locating and navigation errors to a large extent.

8 Claims, 7 Drawing Sheets

(51) Int. Cl.

| | |
|---|---|
| ***B63C 7/02*** | (2006.01) |
| ***B63H 11/00*** | (2006.01) |
| *B63B 27/16* | (2006.01) |

(56) References Cited

U.S. PATENT DOCUMENTS

| | | | | |
|---|---|---|---|---|
| 2017/0029077 | A1* | 2/2017 | Grall | B63B 21/66 |
| 2019/0016425 | A1* | 1/2019 | Mahmoudian | B63G 8/001 |
| 2020/0116886 | A1* | 4/2020 | Hand | G01V 1/3843 |
| 2020/0407061 | A1* | 12/2020 | Hafenrichter | B64D 1/22 |

FOREIGN PATENT DOCUMENTS

| | | | | |
|---|---|---|---|---|
| CN | 106985989 | B | 11/2018 | |
| WO | WO-2019115262 | A1 * | 6/2019 | B63B 27/10 |

* cited by examiner

RECOVERY DEVICE AND RECOVERY METHOD OF UNMANNED UNDERWATER VEHICLES

CROSS-REFERENCE TO RELATED APPLICATIONS

This application claims the benefit of priority from Chinese Patent Application No. 202010183606.9, filed on Mar. 16, 2020. The content of the aforementioned applications, including any intervening amendments thereto, is incorporated herein by reference.

TECHNICAL FIELD

The present application relates to marine detection device, and more particularly to a recovery device and a recovery method for unmanned underwater vehicles (UUVs).

BACKGROUND

Unmanned underwater vehicles (UUVs) refer to underwater vehicles that are remotely or automatically controlled and mainly include intelligent systems that replace divers or manned small-sized underwater vehicles to carry out dangerous underwater operations, such as deep-sea detection, life saving and mine removal. Therefore, the UUVs are also called "diving robots" or "underwater robots". The UUVs can be divided into military ones or civil ones in terms of the application field. The military underwater vehicle can be used as weapons in unmanned combat platforms, which is similar to the unmanned aerial vehicle in use. In the civil field, the UUV can replace divers to carry out operations, such as wreck salvage, deepwater exploration, and the underwater cable laying. Currently, the application of the UUVs is still expanding. For example, the German UUV "Sea Otter" can be used for offshore oil surveys, communication line inspections, military applications, and deep-sea exploration and salvage. The UUV "turtle" developed by Australia is equipped with multiple scanning sonars and cameras, which can be used for real-time exploration. Japanese government also invested 1 billion yen in 2014 to develop UUVs for the development of marine resources, such as rare metals and natural gas.

The following methods are generally adopted for the recovery of the UUVs.

1) The UUVs are recovered through the lifting on the sea surface. Generally, workers take a motor boat to approach the UUV to realize the docking between the recovery mechanism and the UUV. However, such method is greatly affected by wind and waves, and it is prone to equipment damage and personnel safety hazards under severe conditions.

2) Lifting slides or underwater docking devices are adopted in mother ships for the underwater docking, so as to realize the recovery of the UUV. However, the underwater docking is difficult. The UUV has to keep real-time communication with the mother ship, and constantly adjust its attitude to aim at the docking device. Meanwhile, the flow field of the mother ship may have an impact on the movement of the UUV, which increases the difficulty of recovery.

3) Dedicated docking and lifting device is adopted for the docking and recovery of the UUV through towing a rope thrown by the UUV. However, a specific rope-throwing mechanism is required in the UUV, which is very limited and is not adaptable to all UUVs.

Currently, unmanned ships are widely used in surveying, mapping and rescue. If the unmanned ships and the UUVs can be combined, heavy maritime operations are avoided, and improved recovery efficiency and a reduced risk of recovery are obtained. Therefore, it is an inevitable trend to make miniature underwater vehicles and the unmanned ships cooperatively work. For example, Chinese patent application No. 201811517264.9, owned by Shanghai University, discloses a device for recovering unmanned underwater vehicles using unmanned vessels. A gantry and a clamp mechanism on the unmanned vessel are used for lifting and recovery, and the UUV returns to the vicinity of the unmanned vessel through autonomous positioning systems of UUV. The positioning is carried out by a laser rangefinder. However, the unmanned ship with the gantry has a large structure and weight on the deck, which has a high overturning probability during navigation. In addition, it is difficult to find and locate the UUV through the laser or other vision systems such as the PTZ, and the recovery is greatly interfered by the flow field of the mother ship. Moreover, the miniature UUV has poor dynamic positioning performance and large underwater navigation errors, resulting in a low recovery rate and low recovery efficiency for the UUV using the unmanned ship.

SUMMARY

The existing miniature UUVs have poor dynamic positioning performance and large navigation errors, and there is a low recovery rate and low efficiency to recover the miniature UUV using unmanned ships. The present disclosure provides a recovery device and a recovery method for UUVs. The UUV sails to the vicinity of the unmanned ship through inertial navigation or Global Positioning System (GPS), which allows positioning and navigation errors to a large extent. This improves the recovery rate of the miniature UUVs and the recovery efficiency. Therefore, the recovery device and the recovery method of the present disclosure are widely applicable.

The present disclosure provides a recovery device for an unmanned underwater vehicle (UUV), comprising:

a first recovery component arranged on an unmanned ship, and a second recovery component arranged on the UUV;

wherein a magnet is provided on an end of the first recovery component and an end of the second recovery component which are opposite to each other, respectively; a first cable is provided on an end of the first recovery component away from the magnet, and a second cable is provided on an end of the second recovery component away from the magnet; and a thruster is provided on a side of the first recovery component.

A casing which is made of Acrylonitrile Butadiene Styrene (ABS) is provided outside the first recovery component; a ballast block made of fluoropolymer (FPM) is provided at a lower part of the first recovery component, and the magnet is arranged at a middle of the ballast block; the ballast block is provided with a pressure sensor; a steering gear is provided in the first recovery device, and is connected to a propeller; and a propulsion motor is provided at an upper part of the thruster.

A casing which is made of ABS and is corrosion-resistant is provided outside the second recovery component; a ballast block made of FPM is provided at a lower part of the second recovery component; and a seal ring which is corrosion-resistant is provided between the magnet and the casing of the second recovery device.

A thickness of the ballast block of the first recovery component is smaller than that of the ballast block of the second recovery component.

The magnet is an electromagnet, and a shell is provided outside the electromagnet.

A communication line and a power cord are provided in each of the first cable and the second cable; a corrosion-resistant layer is provided on each of the first cable and the second cable; a wear-resistant layer is provided on each of the communication line and the power cord; and a strand is arranged between the wear-resistant layer and the corrosion-resistant layer.

A tension sensor is provided between a bottom of the magnet and the casing of the second recovery component.

A deflector is provided outside the thruster.

The present disclosure further provides an unmanned ship, wherein a moon pool is provided at a middle of the unmanned ship, and a hatch cover is provided below the moon pool; a first recovery component is arranged below the unmanned ship; and a first cable is arranged between the first recovery component and the unmanned ship.

The present disclosure further provides an unmanned underwater vehicle (UUV), wherein a second recovery component is arranged above the UUV; a motor is provided in the UUV; and a second cable is arranged between the second recovery component and the UUV.

The present disclosure further provides a recovery method for an unmanned underwater vehicle (UUV), comprising:

1) releasing a second recovery component located on a top of the UUV and a second cable when the UUV sails back to a vicinity of an unmanned ship;

2) releasing a first recovery component and a first cable of the unmanned ship;

3) turning on an electromagnet of the first recovery component and an electromagnet of the second recovery component, respectively; actuating a thruster of the first recovery component; and making the first recovery component search the second recovery component;

4) connecting the electromagnet of the first recovery component and the electromagnet of the second recovery component through the attraction; retracting the first cable and the second cable; and 5) capturing the UUV to complete the recovery.

Specifically, the step 1 comprises:

allowing the second recovery component to sail back to the vicinity of the unmanned ship through navigation of the UUV; releasing the second recovery component located on the top of the UUV; releasing the second cable by a motor in the UUV to allow the second recovery component to be suspended in water;

the step 2 comprises:

opening a hatch cover of the moon pool of the unmanned ship; releasing the first cable to throw the first recovery component into the water;

the step 3 comprises:

turning on the electromagnet of the first recovery component and the electromagnet of the second recovery component, respectively; actuating the thruster of the first recovery component to allow the unmanned ship to cruise in the water around the the UUV along a broken-line trajectory and to search the UUV in depth from a water surface;

the step 4 comprises:

connecting the electromagnet of the first recovery component and the electromagnet of the second recovery component through the attraction; after a pressure sensor of the first recovery component is subject to a pressure, triggering a relay to actuate a motor of the unmanned ship to retract the first cable; after the second recovery component is captured by the first recovery component, since a tension sensor is subject to a tension, triggering the relay to actuate the motor of the UUV to retract the second cable; and the step 5 comprises:

retracting the second recovery component to a recovery tank on the top of the UUV; and closing the hatch cover after the UUV reaches the moon pool to complete the recovery.

The present invention has the following beneficial effects.

The UUV is recovered using the unmanned ship through the recovery components connected to the cables, which allows the locating and navigation errors to a large extent. When the propulsion failure or electronic circuit failure happens, the electromagnets are adopted in the recovery device of the present invention to realize the quick connection of the two recovery components, so as to quickly recover the UUV, which is efficient. The tension sensor is adopted to check the connection of the recovery components. The recovery method of the present invention is efficient, and is widely applicable for the recovery of the UUV.

Figure 1:
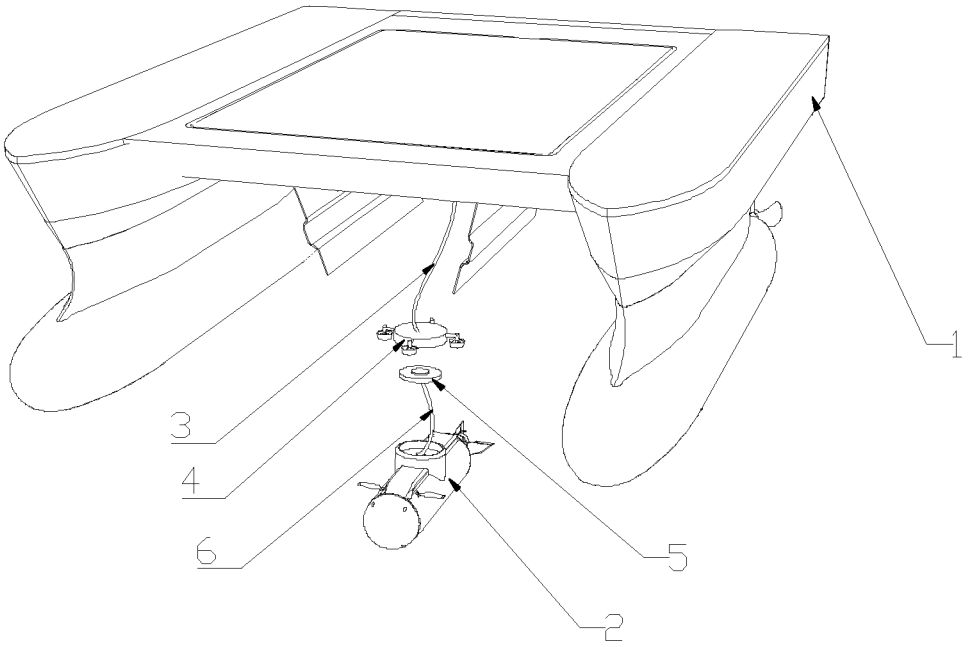
FIG. 1 is a perspective view of an unmanned ship having a recovery device according to an embodiment of the present disclosure.
Figure 2:
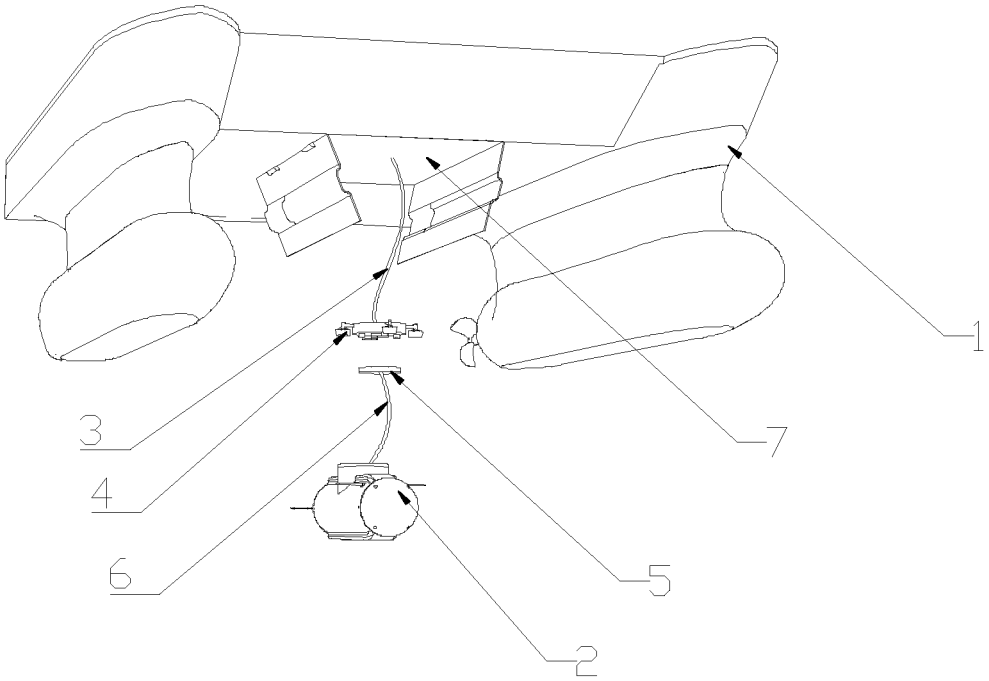
FIG. 2 is another perspective view of the unmanned ship having the recovery device according to an embodiment of the present disclosure.
Figure 3:
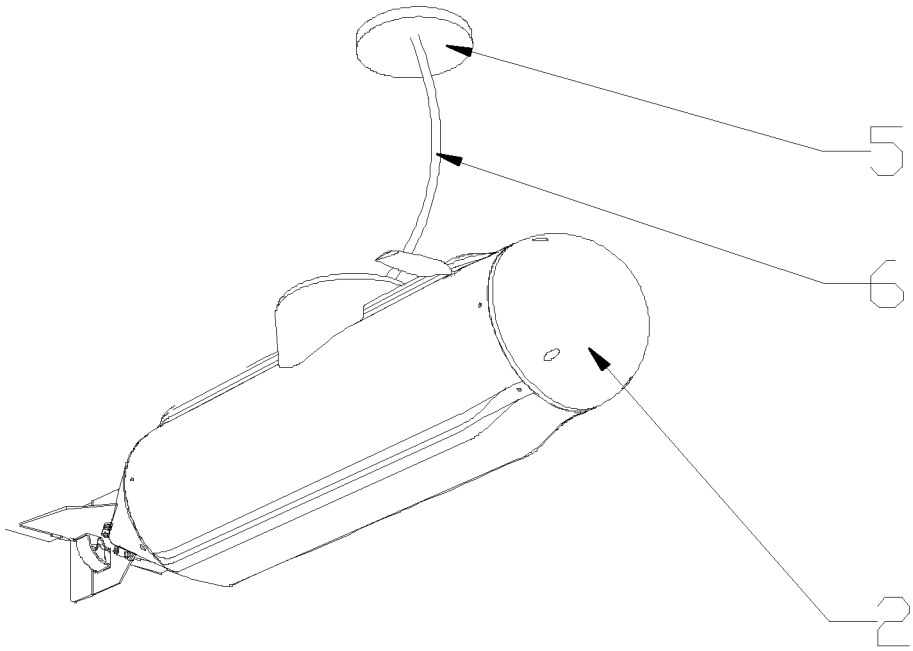
FIG. 3 is a perspective view of an UUV according to an embodiment of the present disclosure, in which a second recovery component is separated from the UUV.
Figure 4:
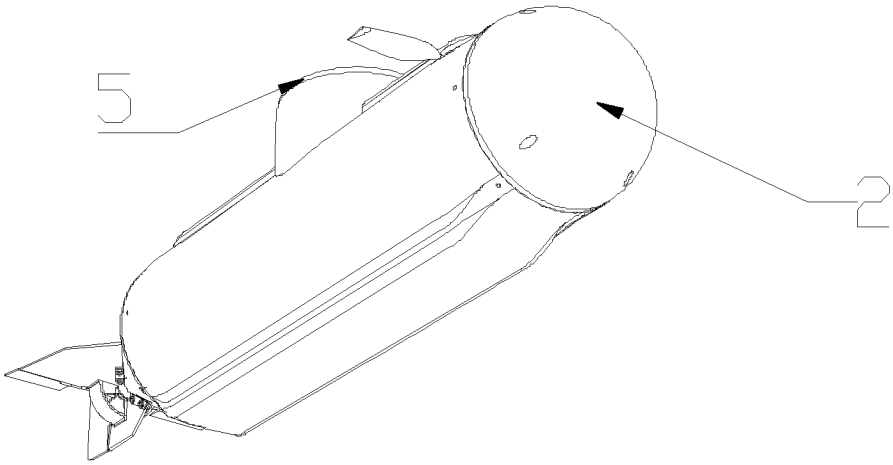
FIG. 4 is a perspective view of the UUV according to an embodiment of the present disclosure, in which the second recovery component is received in the UUV.
Figure 5:
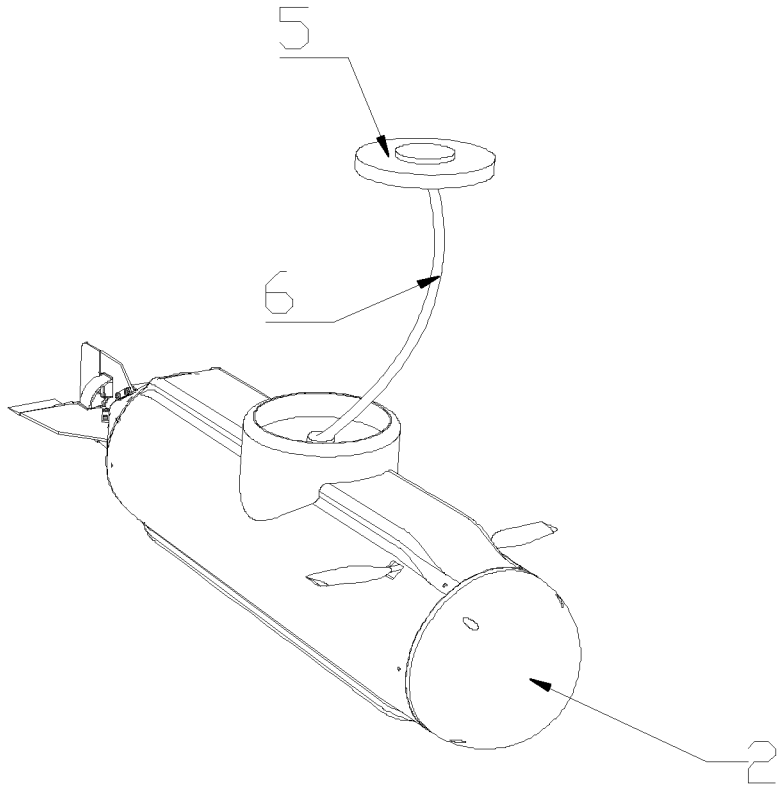
FIG. 5 is another perspective view of the UUV according to an embodiment of the present disclosure, in which the second recovery component is separated from the UUV.
Figure 6:
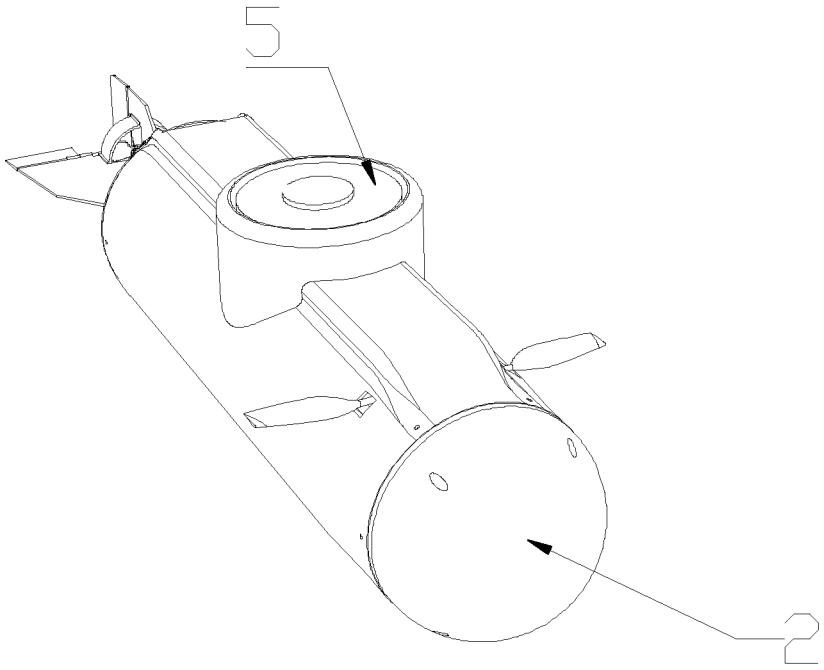
FIG. 6 is another perspective view of the UUV according to an embodiment of the present disclosure, in which the second recovery component is received in the UUV.
Figure 7:
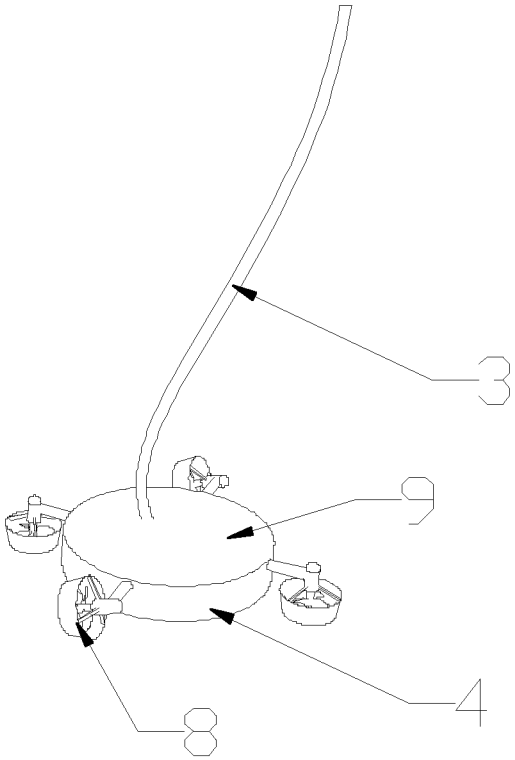
FIG. 7 is a perspective view of a first recovery component according to an embodiment of the present disclosure, in which the first recovery component of the unmanned ship allows a horizontal movement.
Figure 8:
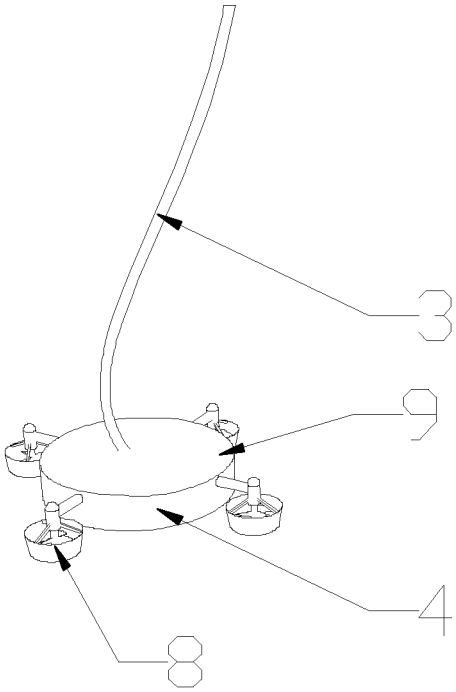
FIG. 8 is a perspective view of the first recovery component according to an embodiment of the present disclosure, in which the first recovery component allows a vertical movement.
Figure 9:
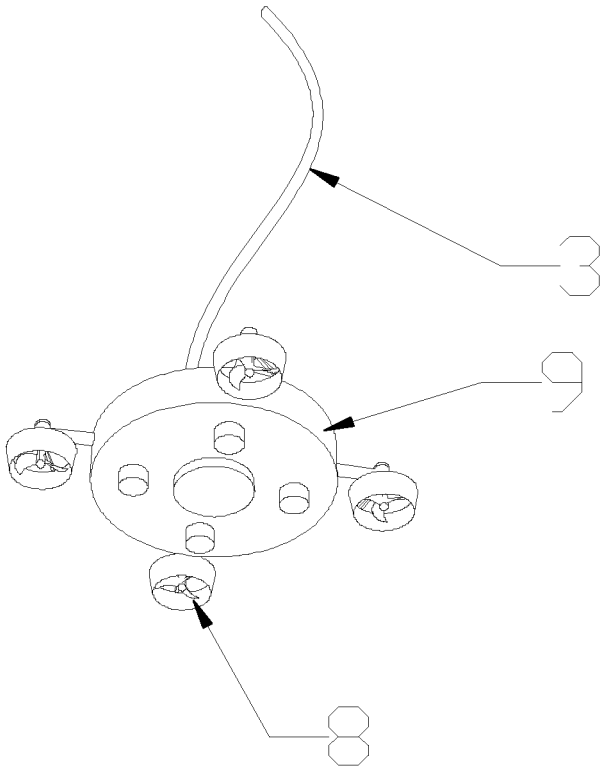
FIG. 9 is another perspective view of the first recovery component according to an embodiment of the present disclosure, in which the first recovery component allows a vertical movement.
Figure 10:
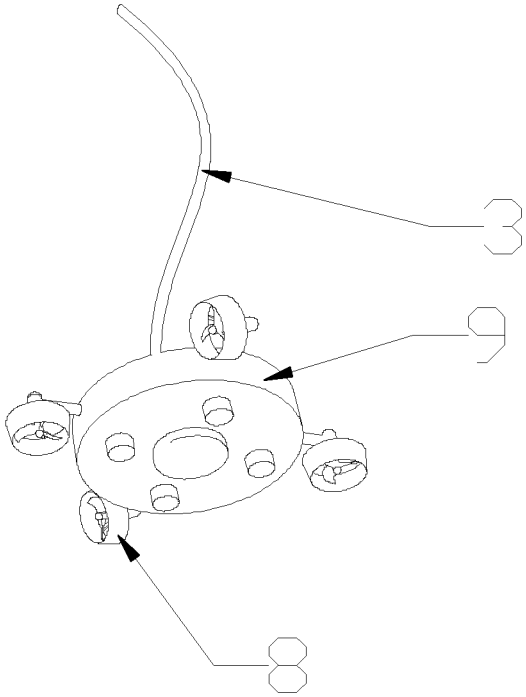
FIG. 10 is another perspective view of the first recovery component according to an embodiment of the present disclosure, in which the first recovery component allows a horizontal movement.
Figure 11:
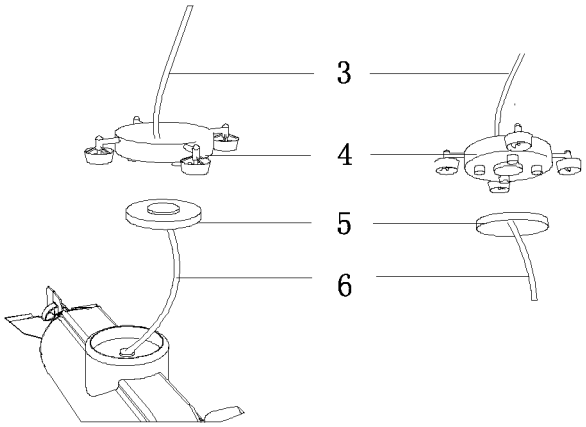
FIG. 11 is a schematic diagram of the recovery device according to an embodiment of the present disclosure.
Figure 12:
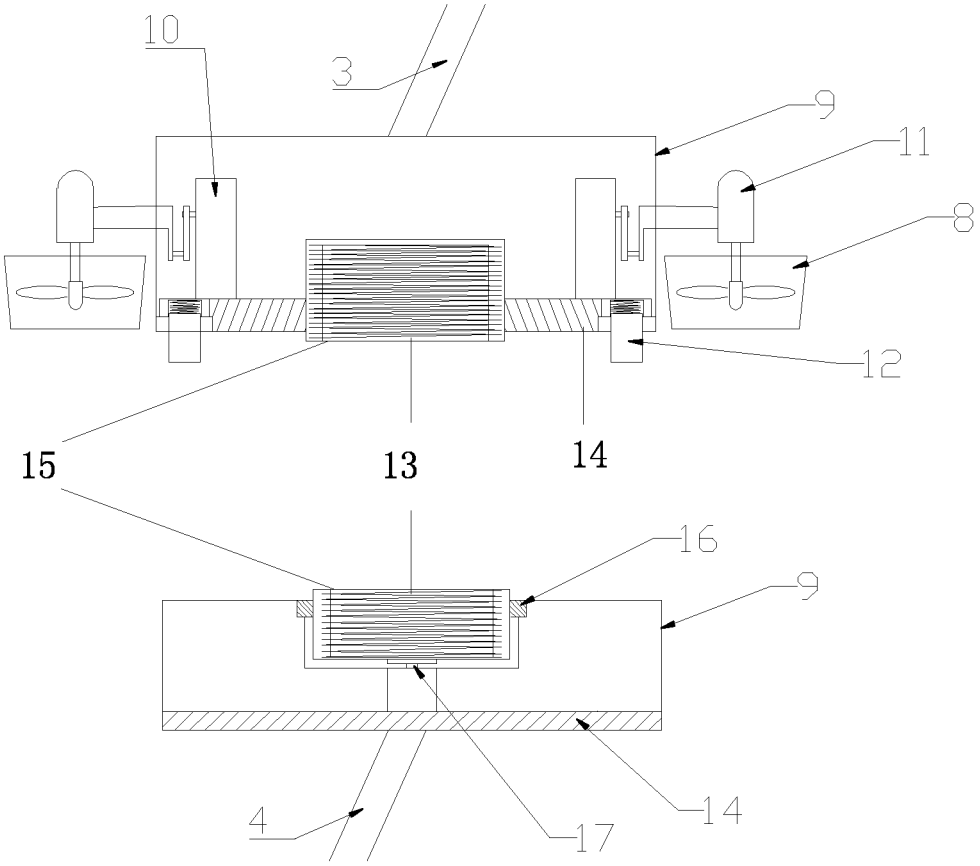
FIG. 12 is a sectional view of the recovery device according to an embodiment of the present disclosure.
Figure 13:
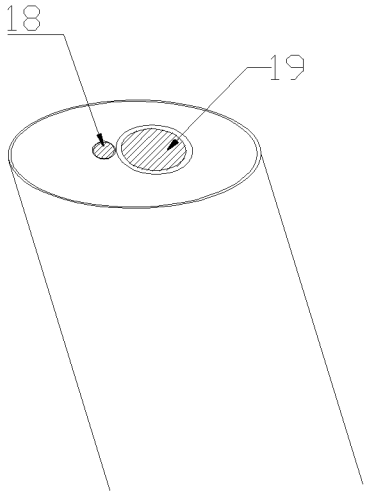
FIG. 13 is a schematic diagram of a cable according to an embodiment of the present disclosure.
Figure 14:
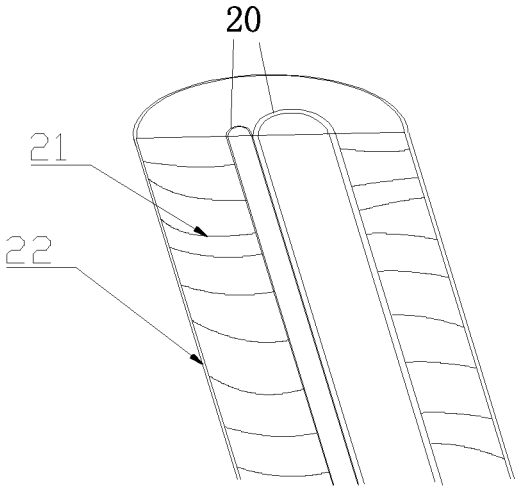
FIG. 14 is a sectional view of the cable taken along a diameter of the cable.
Figure 15:
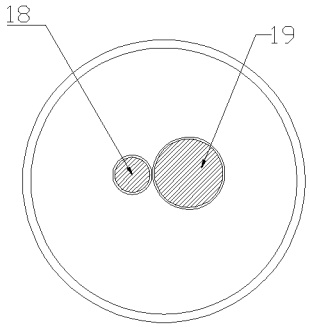
FIG. 15 is a cross-sectional view of the cable according to an embodiment of the present disclosure.

In the drawings: 1, unmanned ship; 2, UUV; 3, first cable; 4, first recovery component; 5, second recovery component; 6, second cable; 7, moon pool; 8, propeller; 9, casing; 10, steering gear; 11, propulsion motor; 12, pressure sensor; 13, electromagnet; 14, ballast block; 15, shell of electromagnet; 16, seal ring; 17, tension sensor; 18, communication line; 19, power cord; 20, wear-resistant layer; 21, strand; 22, corrosion-resistant layer.

DETAILED DESCRIPTION OF EMBODIMENTS

The embodiments of the present disclosure are described in detail below with reference to the accompanying drawings. The described embodiments below are only illustrative, and are not intended to limit the scope of the present disclosure.

For ease of description, the relative positional relationship of components of the present disclosure is described in accordance with the layout of components in FIG. 1, for example, the relative positional relationship, such as "up", "down", "left", "right", etc., is based on the layout of components in FIG. 1.

The unmanned ship 1, the unmanned underwater vehicle (UUV) 2, the first cable 3, the second cable 6, the propeller 8, the steering gear 10, the propulsion motor 11, the pressure sensor 12, the electromagnet 13, the ballast block 14, the seal ring 16, and the tension sensor 17, etc. are all purchased or commercially customized. The pressure sensor 12 is a TST Microelectromechanical System (MEMS) pressure sensor (Kunshan Danrui Sensor Technology Co., Ltd, Kunshan, China), and the tension sensor 17 is a CKY-120A tension sensor (Beijing AVIC Tech Control Technology Co., Ltd, Beijing, China).

As shown in FIGS. 1-15, this embodiment provides a recovery device for a UUV, including a first recovery component 4 arranged on an unmanned ship and a second recovery component 5 arranged on the UUV. Two magnets are provided on an end of the first recovery component 4 and an end of the second recovery component 5 which are opposite to each other, respectively. A first cable 3 is provided on an end of the first recovery component 4 away from the magnet, and a second cable 6 is provided on an end of the second recovery component 5 away from the magnet. A propeller 8 is provided on a side of the first recovery component 4.

In this embodiment, a casing 9 which is made of Acrylonitrile Butadiene Styrene (ABS) and is corrosion-resistant is provided on the first recovery component 4 A ballast block 14 made of high-density fluoropolymer (FPM) is provided at a lower part of the first recovery component 4, and the magnet is arranged at a middle of the ballast block 14. The ballast block 14 is provided with a pressure sensor 12. A steering gear 10 is provided inside the recovery device 4 of the unmanned ship, and is connected to the propeller 8. A propulsion motor 11 is provided at an upper part of the propeller 8.

A casing 9 which is made of ABS and is corrosion-resistant is provided on the second recovery component 5. A ballast block 14 made of high-density FPM is provided at a lower part of the second recovery component 5. A seal ring 16 which is corrosion-resistant is provided between the magnet and the casing 9 of the second recovery component 5.

A thickness of the ballast block 14 of the first recovery component 4 is smaller than that of the ballast block 14 of the second recovery component 5.

In this embodiment, the magnet is an electromagnet 13, and a shell 15 which is corrosion-resistant and anti-slip is provided outside the electromagnet 13.

In this embodiment, a communication line 18 and a power cord 19 are provided in each of the first cable 3 of the unmanned ship and the second cable 6 of the UUV. A corrosion-resistant layer 22 is provided on each of the first cable 3 and the second cable 6. A wear-resistant layer 20 is provided on each of the communication line 18 and the power cord 19. A strand 21 is arranged between the wear-resistant layer 20 and the corrosion-resistant layer 22, and the strand 21 is a high-strength strand 21 which is made of polypropylene and formed by twisting.

In this embodiment, a tension sensor 17 is provided between a bottom of the magnet and the casing 9 of the second recovery component 5.

In this embodiment, a deflector is provided outside the propeller 8.

The present disclosure further provides an unmanned ship 1. A moon pool 7 is provided at a middle of the unmanned ship 1, and a hatch cover is provided below the moon pool 7. A first recovery component 4 is arranged below the unmanned ship 1. A first cable 3 is arranged between the first recovery component 4 and the unmanned ship 1, and a motor is provided between the unmanned ship 1 and the first cable 3.

The present disclosure further provides a UUV 2. A second recovery component 5 is arranged above the UUV 2. A second cable 6 is arranged between the second recovery component 5 and the UUV 2, and a motor is provided in the UUV 2. The motor is equipped with the second cable 6.

The present disclosure further provides a recovery method for the UUV 2. First, the UUV 2 sails to the vicinity of the unmanned ship 1 through inertial navigation or the Global Positioning System (GPS). The UUV 2 releases the second recovery component 5 on a top of the UUV 2, and the motor releases the second cable 6 to allow the second recovery component 5 to be suspended in water.

The hatch cover of the moon pool 7 of the unmanned ship 1 is opened, and the first cable 3 is released through the motor in the moon pool 7 to throw the first recovery component 4 into the water. The ballast block is provided at a bottom of each of the first recovery component 4 of the unmanned ship and the second recovery component 5 of the UUV, and there is a large space in the middle and the upper part of the first recovery component 4 and the second recovery component 5, so that a center of gravity of the first recovery component 4 and the second recovery component 5 is lower than a center of buoyancy thereof, and both the first recovery component 4 and the second recovery component 5 have good stability. This enables the electromagnet 13 to be in a vertical state, thus ensuring the coupling of the first recovery component 4 of the unmanned ship and the second recovery component 5. The ballast block 14 on the first recovery component 4 and the ballast block 14 on the second recovery component 5 have different weights, so that the density of the second recovery component 5 of the UUV is slightly less than that of water, and the density of the first recovery component 4 of the unmanned ship is slightly greater than that of the water.

After the first recovery component 4 is released into the water, the electromagnet 13 is turned on, and the four propellers 8 of the first recovery component 4 activated, where the four propellers 8 are rotatable by 90 degrees. The arrangement of the four propellers 8 realizes the flexible movement of the first recovery component 4 in multiple degrees of freedom in the water. The first recovery component 4 cruises in the water around the UUV 2, and searches in the vertical direction from the surface of the water. Since the unmanned ship 1 has already reached the anchor point of the UUV 2, the first recovery component 4 and the second recovery component 5 can be connected due to the attraction of the electromagnet 13.

At the same time, four push buttons of the pressure sensor 12 of the first recovery component 4 will trigger the relay after being pressed to start the motor of the unmanned ship to retract the cable of the unmanned ship. After the second recovery component 5 is "captured" by the first recovery component 4, the tension sensor 17 in the first recovery component 5 is subject to an increased tension, and the relay is triggered to actuate the motor of the UUV to retract the second cable 6 of the UUV. When the second recovery component 5 returns to a recovery tank on the top of the UUV, the UUV 2 reaches the moon pool 7, and the hatch cover is closed. The recovery is completed.

The above are only preferred embodiments of the present disclosure, and are not intended to limit the scope of the present disclosure. Any modification, equivalent replacement and improvement made by those of ordinary skill in the art within the spirit of the present disclosure shall fall within the protection scope of the present disclosure.

What is claimed is:

1. A recovery device for an unmanned underwater vehicle (UUV), comprising:

a first recovery component provided on an unmanned ship, and a second recovery component provided on the UUV;

wherein a magnet is provided on an end of the first recovery component and an end of the second recovery component which are opposite to each other, respectively; a first cable is provided on an end of the first recovery component away from the magnet, and a second cable is provided on an end of the second recovery component away from the magnet; and a thruster is provided on a side of the first recovery component.

2. The recovery device of claim 1, wherein a casing is provided outside the first recovery component; a ballast block is provided at a lower part of the first recovery component, and the magnet is arranged at a middle of the ballast block; the ballast block is provided with a pressure sensor; a steering gear is provided inside the first recovery component, and is connected to the thruster; a propulsion motor is provided at an upper part of the thruster; and a tension sensor is provided between a bottom of the magnet and the casing of the second recovery component.

3. The recovery device of claim 2, wherein the magnet is an electromagnet, and a shell is provided outside the electromagnet.

4. The recovery device of claim 1, wherein a communication line and a power cord are provided in each of the first cable and the second cable; a corrosion-resistant layer is provided on each of the first cable and the second cable; a wear-resistant layer is provided on each of the communication line and the power cord; and a strand is arranged between the wear-resistant layer and the corrosion-resistant layer.

5. The recovery device of claim 2, wherein a deflector is provided outside the thruster; the casing is made of ABS and is corrosion-resistant; the ballast block is made of fluoropolymer (FPM); and the thruster is a propeller.

6. The recovery device of claim 1, wherein a casing is provided outside the second recovery component; a ballast block is provided at a lower part of the second recovery component; a seal ring is provided between the magnet and the casing of the second recovery component; and a thickness of the ballast block of the first recovery component is smaller than that of the ballast block of the second recovery component.

7. A recovery method for an unmanned underwater vehicle (UUV), comprising:

1) releasing a second recovery component located on a top of the UUV and a second cable of the UUV when the UUV sails back to a vicinity of an unmanned ship;
2) releasing a first recovery component of the unmanned ship and a first cable of the unmanned ship;
3) turning on an electromagnet of the first recovery component and an electromagnet of the second recovery component, respectively; actuating a thruster of the first recovery component; and making the first recovery component search the second recovery component;
4) connecting the electromagnet of the first recovery component and the electromagnet of the second recovery component through the attraction; retracting the first cable and the second cable; and
5) capturing the UUV to complete the recovery.

8. The recovery method of claim 7, wherein the step 1 comprises:

allowing the second recovery component to sail back to the vicinity of the unmanned ship through navigation of the UUV; releasing the second recovery component located on the top of the UUV; releasing the second cable by a motor in the UUV to allow the second recovery component to be suspended in water;

the step 2 comprises:

opening a hatch cover of the moon pool of the unmanned ship; releasing the first cable to throw the first recovery component into the water;

the step 3 comprises:

turning on the electromagnet of the first recovery component and the electromagnet of the second recovery component, respectively; actuating the thruster of the first recovery component to allow the unmanned ship to cruise in the water around the the UUV along a broken-line trajectory and to search the UUV in depth from a water surface;

the step 4 comprises:

connecting the electromagnet of the recovery component of the unmanned ship and the electromagnet of the recovery component of the UUV through the attraction; after a pressure sensor of the recovery component of the unmanned ship is subject to a pressure, triggering a relay to actuate a motor of the unmanned ship to retract the cable of the unmanned ship; after the recovery component of the unmanned ship is captured by the recovery component of the UUV, since a tension sensor is subject to a tension, triggering the relay to actuate the motor of the UUV to retract the cable of the UUV; and the step 5 comprises:

retracting the second recovery component to a recovery tank on the top of the UUV; and closing the hatch cover after the UUV reaches the moon pool to complete the recovery.

* * * * *